US006653925B1

(12) United States Patent
Asami et al.

(10) Patent No.: US 6,653,925 B1
(45) Date of Patent: Nov. 25, 2003

(54) METHOD FOR INSULATING LEADS OF THERMAL FUSE WITH INSULATING TUBES AND THERMAL FUSE THEREFOR

(75) Inventors: Yoshio Asami, Ogose-machi (JP); Shinichi Kato, Akishima (JP)

(73) Assignee: Anzen Dengu Kabushiki Kaisha, Tokyo (JP)

( * ) Notice: Subject to any disclaimer, the term of this patent is extended or adjusted under 35 U.S.C. 154(b) by 121 days.

(21) Appl. No.: 09/687,740

(22) Filed: Oct. 13, 2000

(30) Foreign Application Priority Data

Jun. 16, 2000 (JP) ..... 2000-181505

(51) Int. Cl.[7] ..... H01H 85/143; H01H 85/147; H01H 69/02

(52) U.S. Cl. ..... 337/401; 337/413; 337/414; 337/399; 337/180; 337/268; 29/623

(58) Field of Search ..... 337/401, 20, 34, 337/86, 109, 112, 113, 121, 122, 137, 180, 186, 187, 251, 268, 309, 327, 329, 373, 380, 381, 398, 399, 413, 414; 29/623

(56) References Cited

U.S. PATENT DOCUMENTS

| | | | | | |
|---|---|---|---|---|---|
| 3,721,749 | A | * | 3/1973 | Clabbum | 174/88 R |
| 3,810,074 | A | * | 5/1974 | Brandenburg, Jr. | 439/125 |
| 4,060,304 | A | * | 11/1977 | Abramson | 439/730 |
| 4,640,725 | A | * | 2/1987 | Jones | 156/293 |
| 4,717,608 | A | * | 1/1988 | Meltsch | 138/89 |
| 4,852,252 | A | * | 8/1989 | Ayer | 174/84 R |
| 5,098,319 | A | * | 3/1992 | McGaffigan et al. | 174/DIG. 8 |
| 5,109,603 | A | * | 5/1992 | Boulanger | 174/65 R |
| 5,136,549 | A | * | 8/1992 | Berglund | 181/112 |
| 5,137,478 | A | * | 8/1992 | Graf et al. | 174/84 R |
| 5,352,858 | A | * | 10/1994 | Keck | 200/302.1 |
| 5,770,993 | A | | 6/1998 | Miyazawa et al. | |
| 5,905,426 | A | * | 5/1999 | Douglass | 337/228 |
| 6,185,086 | B1 | * | 2/2001 | Tanaka et al. | 361/301.1 |

FOREIGN PATENT DOCUMENTS

| | | | | | |
|---|---|---|---|---|---|
| DE | 19639427 | A1 | | 3/1997 | |
| GB | 2126804 | A | * | 3/1984 | H01B/3/48 |
| JP | 7-6677 | A | * | 1/1995 | H01H/37/76 |
| JP | 07047082 | A | | 2/1995 | |
| JP | 8-153452 | A | * | 6/1996 | H01H/37/76 |
| JP | 09259723 | A | | 3/1997 | |
| JP | 9-259723 | | * | 10/1997 | H01H/37/76 |
| JP | 2000-52365 | A | * | 2/2000 | B29C/43/18 |
| JP | 2000048696 | A | | 2/2000 | |

* cited by examiner

*Primary Examiner*—Anatoly Vortman
(74) *Attorney, Agent, or Firm*—Dennis G. LaPointe; Mason Law, P.A.

(57) ABSTRACT

There is provided a method for insulating leads of a thermal fuse with an insulating tube that can reduce the quantity of the adhesive and prevent the defect of appearance and the lowering of the value of the product, by applying an adhesive on the circumference of the leads, and putting the insulating tube on the lead from the outer end of the lead while rotating the insulating tube, so that the adhesive is present inside the insulating tube. There is also provided a low-cost, downsized thermal fuse with excellent heat resistance, by using the alloy that has a melting point of 190° C. or above as the fusible alloy, and a copper wire plated with an Sn—Cu alloy for the lead.

17 Claims, 4 Drawing Sheets

PRIOR ART

METHOD FOR INSULATING LEADS OF THERMAL FUSE WITH INSULATING TUBES AND THERMAL FUSE THEREFOR

BACKGROUND OF THE INVENTION

1. Field of the Invention

The present invention relates to a method for insulating with insulating tubes, leads of a non-reversible thermal fuse that is used in small transformers, heat sinks, or power transistors for domestic and industrial apparatus as a safety measure, and is fused at a temperature above an allowable temperature.

2. Description of Related Art

FIG. 1 shows a conventional axial-type thermal fuse. The circumference of leads 3 of this type of thermal fuse may be insulated with an insulating tubes 4 as a safety measure.

FIG. 2 shows a conventional radial-type thermal fuse. The circumference of leads 3 of this type of thermal fuse may also be insulated with insulating tubes 4.

In FIGS. 1 and 2, the leads 3 may be insulated with insulating tubes 4 during the manufacturing process of the thermal fuse, or insulated with insulating tubes 4 after the thermal fuse made with non-insulated leads 3 has been manufactured.

In the latter case, the insulating tubes 4 are put on the circumference of the leads 3, and when an end of the insulating tube 4 contacts a seal 2 of the thermal fuse, it is fixed to the seal 2 by applying an adhesive 5 around the end of the insulating tube 4.

In this case, since the adhesive 5 is heaped around the end of the insulating tube 4 and the seal 2 as a band, the quantity of the adhesive 5 may increase, the adhesive 5 may overflow to a side of the case to degrade the appearance, and the value of the product may be lowered.

A thermal fuse is provided with a fusible alloy that constitutes a fuse element, and a resin-pellet-type fusible alloy is generally used. However, such a fusible alloy has problems of a high unit price, and a large size.

The leads 3 are plated with 100% tin (Sn), which has a problem of low heat resistance when being soldered.

SUMMARY OF THE INVENTION

An object of the present invention is to provide a method for insulating leads of a thermal fuse with insulating tubes, for reducing the quantity of an adhesive used, and preventing the adhesive from heaping at the seal, by applying the adhesive around the circumference of the leads, putting insulating tubes on the leads from the outer ends, rotating the insulating tubes so that the adhesive is present inside the insulating tubes. It is another object of the present invention to provide a thermal fuse intended to reduce the costs of the thermal fuse by using an alloy having a melting point of 190° C. or above as the fusible alloy 6, and intended to improve the heat resistance of the leads by plating the leads with an alloy of tin (Sn) and copper (Cu).

DETAILED DESCRIPTION OF THE INVENTION

A preferred embodiment of the present invention will be described below referring to the attached drawings.

Figure 1:
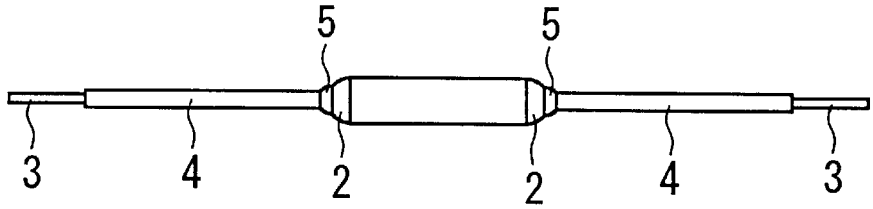
FIG. 1 is a diagram showing the constitution of a conventional axial-type thermal fuse.
Figure 2:
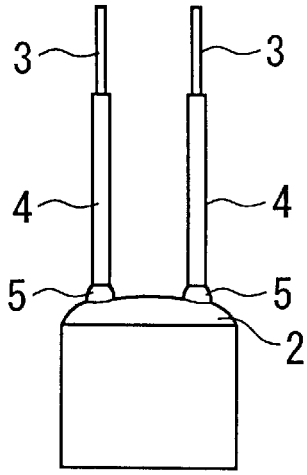
PRIOR ART FIG. 2
FIG. 2 is a diagram showing the constitution of a conventional radial-type thermal fuse.
Figure 3:
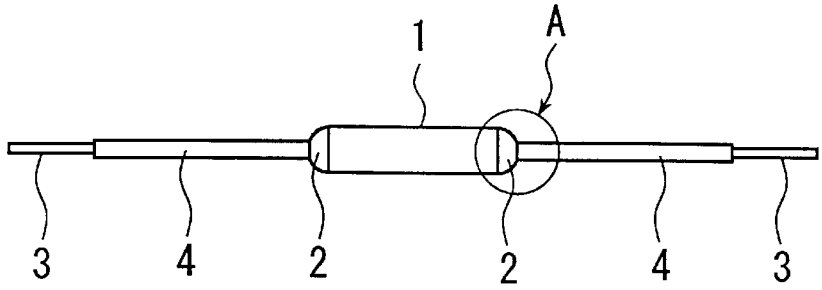
FIG. 3 is a diagram showing the appearance of an axial-type thermal fuse according to the present invention.

FIG. 3 is a diagram showing the appearance of an axial-type thermal fuse according to the present invention.

Figure 4:
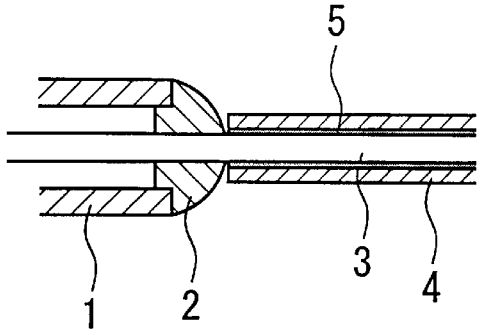
FIG. 4 is an enlarged view taken from A of FIG. 3.

In FIG. 3, a seal 2 made of an epoxy resin is provided on each end of an insulating case 1, and the circumference of the leads 3 protruding from the seals 2 are insulated by insulating tubes 4. As shown in FIG. 4, the insulating tubes 4 are fixed to leads 3 by an adhesive 5, and the inner ends of the tubes 4 contact the seals 2.

Figure 5:
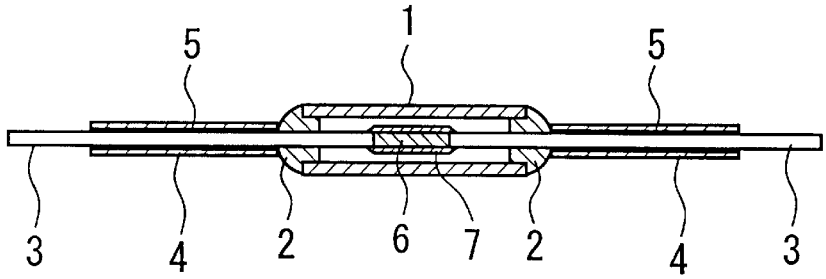
FIG. 5 is cross-sectional view of the axial-type thermal fuse of FIG. 3.

FIG. 5 is cross-sectional view of the axial-type thermal fuse of FIG. 3.

FIG. 5 shows the internal structure of the thermal fuse. The case 1 is made typically of a cylindrical ceramic or an insulating resin molding provided with leads 3 in the axial direction. If an alloy having a melting point of 190° C. or above is used as the fusible alloy 6 that forms a fuse element on the central portion of the case 1, the manufacturing costs can be made lower than those of the conventional resin-pellet-type fusible alloy. As the alloy-type fusible alloy 6, for example, a tin (Sn)-silver (Ag)-based alloy having a melting point of about 221° C., or a tin (Sn)-lead (Pb)-based alloy having a melting point of about 240° C. can be used.

The leads 3 plated with 100% tin (Sn) have lower resistance to heat of soldering. Therefore, the leads plated with tin (Sn)-Copper (Cu) alloy improve heat resistance, and prevent deterioration caused by high temperature.

A rosin-based flux 7 is applied around the fusible alloy 6. The rosin-based flux 7 prevents oxidation of the fusible alloy 6, and facilitates the fusible alloy 6 to separate as spheres.

An opening at each end of the case 1 is closed by a seal 2 made of an epoxy-based synthetic resin, which also fixes the lead 3.

The circumference of the leads 3 is covered with an insulating tube with an epoxy or acrylic adhesive 5 between the leads 3 and the tubes 4. The insulating tubes 4 are made of polyvinyl chloride, polyethylene, or nylon.

Figure 6:
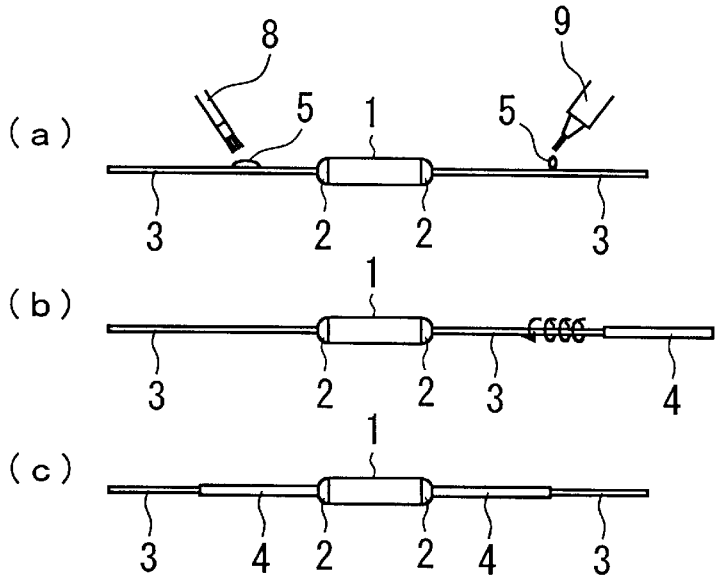
FIG. 6 is a diagram showing the process steps for insulating a thermal fuse according to the present invention with an insulating tube.

FIG. 6 is a diagram showing the process steps for putting the insulating tubes 4 to a thermal fuse according to the present invention.

First, as shown in FIG. 6, step (a), a thin layer of an adhesive 5 is applied to the outer surface of the lead 3 using a brush 8 or a syringe 9. The thickness of the adhesive layer is, for example, 5 $\mu$m to 500 $\mu$m.

Next, as shown in FIG. 6, step (b), an insulating tube 4 is put onto the lead 3 from the outer end of the lead 3 while rotating the insulating tube 4 clockwise or counterclockwise as shown by the arrow. By thus rotating the insulating tube 4, the adhesive 5 enters inside of the insulating tube 4, and is not exposed outside. In this case, the inner diameter of the insulating tube 4 and the diameter of the lead 3 should be designed so that the adhesive 5 can enter the hollow of the lead 3. When the diameter of the lead 3 is, for example, 0.4 mm to 1.5 mm, the inner diameter of the insulating tube 4 is preferably 0.41 mm to 1.6 mm.

Next, as is shown in FIG. 6, step (c), the operation is completed when the inner end of the insulating tube 4 contacts the seal 2, and when the adhesive 5 in the insulating tube 4 is cured, a thermal fuse with insulating tubes is completed.

Figure 7:
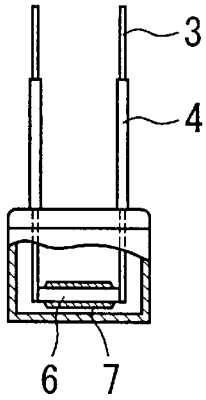
FIG. 7 is a diagram showing the appearance of a radial-type thermal fuse according to the present invention.

FIG. 7 is a diagram showing the appearance of a radial-type thermal fuse according to the present invention.

In FIG. 7, the leads 3 of the radial-type thermal fuse are insulated by an insulating tubes 4 in the similar manner as in the axial-type thermal fuse. The internal structure of the radial-type thermal fuse, such as the fusible alloy 6 and rosin-based flux 7, is basically the same as in the above-described axial-type thermal fuse.

According to the present invention, as described in detail above, since an adhesive is applied to the circumference of the leads, and insulating tubes are put onto the leads from the outer ends of the leads rotating the insulating tubes, the quantity of the adhesive can be reduced, and the adhesive enters the insulating tubes with substantially no adhesive exposed outside. Therefore, the leakage of the adhesive to the outside of the case can be prevented. The defect of appearance and the lowering of the value of the product can also be prevented.

Since the alloy that has a melting point of 190° C. or above is used as the fusible alloy, cost reduction and size reduction can be achieved in comparison with conventional resin-pellet-type fusible alloys.

Furthermore, since copper wires plated with an alloy of tin (Sn) and copper (Cu) are used for the leads, heat resistance can be improved.

What is claimed is:

1. A method for insulating leads of a thermal fuse with insulating tubes (4), said thermal fuse comprising a fusible alloy (6) accommodated in an insulating case (1), and leads (3) that are connected to both ends of said fusible alloy (6) and that protrude externally from seals (2) provided on openings of the both ends of said insulating case (1), wherein an inner diameter of the insulating tubes (4) and an outer diameter of the leads (3) is chosen so that there exists a hollow space for an adhesive (5) between an outer circumference of the leads (3) and an inner circumference of the insulating tubes (4) put on the leads (3), in which method, the adhesive (5) is applied to the circumferences of said leads (3), and the insulating tubes (4) are put on surfaces of the leads (3) while rotating the insulating tubes (4), so that the adhesive (5) is present inside the insulating tubes (4) in said hollow space.

2. The method according to claim 1, wherein said fusible alloy (6) being an alloy having a melting point of 190° C. or above.

3. The method according to claim 1, wherein said fusible alloy (6) has a melting point of about 221° C., and is an alloy of tin (Sn) and silver (Ag).

4. The method according to claim 1, wherein said fusible alloy (6) has a melting point of about 240° C., and is an alloy of tin (Sn) and lead (Pb).

5. The method according to claim 1, wherein said leads (3) comprise copper wires plated with an alloy of tin (Sn) and copper (Cu).

6. The method according to claim 1, wherein the outer diameter of the leads (3) is in the range of approximately 0.4 mm to approximately 1.5 mm and the inner diameter of the insulating tubes (4) is in the range of approximately 0.41 mm to approximately 1.6 mm.

7. The method according to claim 3, wherein the outer diameter of the leads (3) is in the range of approximately 0.4 mm to approximately 1.5 mm and the inner diameter of the insulating tubes (4) is in the range of approximately 0.41 mm to approximately 1.6 mm.

8. The method according to claim 4, wherein the outer diameter of the leads (3) is in the range of approximately 0.4 mm to approximately 1.5 mm and the inner diameter of the insulating tubes (4) is in the range of approximately 0.41 mm to approximately 1.6 mm.

9. The method according to claim 5, wherein the outer diameter of the leads (3) is in the range of approximately 0.4 mm to approximately 1.5 mm and the inner diameter of the insulating tubes (4) is in the range of approximately 0.41 mm to approximately 1.6 mm.

10. The method according to claim 1, wherein the thickness of the adhesive layer is in the range of approximately 5 $\mu$m to approximately 500 $\mu$m.

11. The method according to claim 3, wherein the thickness of the adhesive layer is in the of approximately 5 $\mu$m to approximately 500 $\mu$m.

12. The method according to claim 4, wherein the thickness of the adhesive layer is in the of approximately 5 $\mu$m to approximately 500 $\mu$m.

13. The method according to claim 5, wherein the thickness of the adhesive layer is in the of approximately 5 $\mu$m to approximately 500 $\mu$m.

14. The method according to claim 6, wherein the thickness of the adhesive layer is in the of approximately 5 $\mu$m to approximately 500 $\mu$m.

15. The method according to claim 7, wherein the thickness of the adhesive layer is in the of approximately 5 $\mu$m to approximately 500 $\mu$m.

16. The method according to claim 8, wherein the thickness of the adhesive layer is in the of approximately 5 $\mu$m to approximately 500 $\mu$m.

17. The method according to claim 9, wherein the thickness of the adhesive layer is in the of approximately 5 $\mu$m to approximately 500 $\mu$m.

* * * * *

UNITED STATES PATENT AND TRADEMARK OFFICE

CERTIFICATE OF CORRECTION

PATENT NO. : 6,653,925 B1
DATED : November 25, 2003
INVENTOR(S) : Yoshio Asami et al.

It is certified that error appears in the above-identified patent and that said Letters Patent is hereby corrected as shown below:

Title page,
Item [75], Inventors, replace city of inventor #1 with -- Saitama --; and replace city of inventor #2 with -- Tokyo --.

Column 4,
Lines 36, 39, 42, 45, 48 and 51, replace "layer is in the of" with -- layer is in the range of --.

Signed and Sealed this

Ninth Day of March, 2004

JON W. DUDAS
*Acting Director of the United States Patent and Trademark Office*